United States Patent [19]

Hashimoto et al.

[11] 4,390,608

[45] Jun. 28, 1983

[54] LAYERED CHARGE GENERATOR/TRANSPORT ELECTROPHOTOGRAPHIC PHOTOCONDUCTOR USES BISAZO PIGMENT

[75] Inventors: Mitsuru Hashimoto, Numazu; Masaomi Sasaki, Susono; Toshio Fukagai, Numazu, all of Japan; Tatsuya Katoh, deceased, late of Yokodera, Japan, by Tazuki Katoh, heir; by Mankichi Katoh, heir, Yokohama, Japan

[73] Assignee: Ricoh Company, Ltd., Tokyo, Japan

[21] Appl. No.: 329,083

[22] Filed: Dec. 9, 1981

[30] Foreign Application Priority Data

| | | | |
|---|---|---|---|
| Dec. 9, 1980 | [JP] | Japan | 55-173692 |
| Dec. 9, 1980 | [JP] | Japan | 55-173693 |
| Dec. 9, 1980 | [JP] | Japan | 55-173694 |
| Dec. 9, 1980 | [JP] | Japan | 55-173695 |
| Dec. 9, 1980 | [JP] | Japan | 55-173696 |
| Dec. 9, 1980 | [JP] | Japan | 55-173697 |
| Dec. 9, 1980 | [JP] | Japan | 55-173698 |
| Dec. 19, 1980 | [JP] | Japan | 55-178754 |
| Dec. 19, 1980 | [JP] | Japan | 55-178764 |
| Dec. 19, 1980 | [JP] | Japan | 55-178773 |
| Dec. 19, 1980 | [JP] | Japan | 5 5-178774 |
| Dec. 19, 1980 | [JP] | Japan | 55-178775 |
| Dec. 19, 1980 | [JP] | Japan | 55-178776 |
| Dec. 19, 1980 | [JP] | Japan | 55-178777 |
| Dec. 19, 1980 | [JP] | Japan | 55-178778 |
| Dec. 19, 1980 | [JP] | Japan | 55-178779 |

[51] Int. Cl.[3] ..... G03G 5/06

[52] U.S. Cl. ..... 430/57; 430/58; 430/72; 430/135; 430/59; 260/152; 260/156; 260/193

[58] Field of Search ..... 430/58, 59, 57, 71, 430/72, 73, 135; 260/156, 152, 193

[56] References Cited

U.S. PATENT DOCUMENTS 4,327,168 4/1982 Hashimoto ..... 430/58

*Primary Examiner*—John D. Welsh

*Attorney, Agent, or Firm*—Flynn, Thiel, Boutell & Tanis

[57] ABSTRACT

A layered electrophotographic photoconductor whose charge generation layer comprises a bisazo pigment selected from the group consisting of the bisazo pigments represented by formula (1) and whose charge transport layer contains a charge transport material selected from the group consisting of anthrancene compounds represented by formula (2) or from the group consisting of distyrylbenzene compounds represented by formula (3)

(1)

(2)

(3)

11 Claims, 1 Drawing Figure

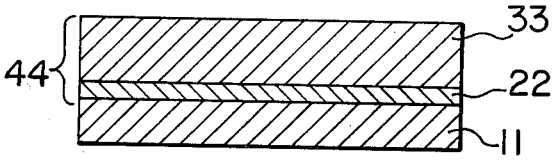
33
44
22
11

LAYERED CHARGE GENERATOR/TRANSPORT ELECTROPHOTOGRAPHIC PHOTOCONDUCTOR USES BISAZO PIGMENT

BACKGROUND OF THE INVENTION

The present invention relates to a layered electrophotographic photoconductor comprising an electroconductive support material and a photoconductive double layer which consists of a charge generation layer and a charge transport layer. In particular, it is concerned with a layered electrophotographic photoconductor whose charge generation layer comprises a bisazo pigment selected from the group consisting of the bisazo pigments represented by the general formula (1) and whose charge transport layer contains a charge transport material selected from the group consisting of the anthracene compounds represented by the general formula (2) and distyrylbenzene compounds represented by the general formula (3)

(1)

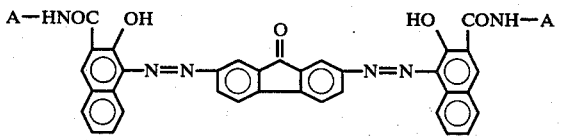

wherein A represents $—C_6H_4—Cl(o)$, $—C_6H_4—Cl(m)$, $—C_6H_4—Br(o)$, $—C_6H_4—Br(m)$, $—C_6H_4—F(o)$, $—C_6H_4—F(m)$, $—C_6H_4—F(p)$, or $—C_6H_4—I(m)$;

(2)

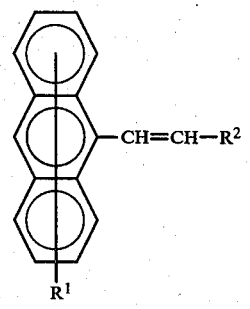

wherein $R^1$ represents hydrogen or halogen; and $R^2$ represents a substituted or unsubstituted phenyl group, a naphthyl group, an anthryl group or a carbazole group, (3)

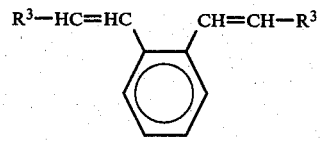

wherein $R^3$ represents a carbazolyl group, a pyridyl group, a thienyl group, an indolyl group, a furyl group, a phenyl group, a styryl group, a naphthyl group, an anthryl group, which phenyl group, styryl group, naphthyl group and anthryl group are unsubstituted or substituted with one member selected from the group consisting of a dialkylamino group, an alkyl group, an alkoxy group, a carboxyl group or an esterified carboxyl group, halogen, a cyano group, an aralkylamino group, an amino group, a hydroxy group, a nitro group and an acetylamino group.

Conventionally, a variety of inorganic and organic electrophotographic photoconductors are known. As inorganic electrophotographic photoconductors, there are known, for instance, a selenium photoconductor, a selenium-alloy photoconductor, and a zinc oxide photoconductor which is prepared by sensitizing zinc oxide with a sensitizer pigment and dispersing the same in a binder resin. Furthermore, as a representative example of organic electrophotographic photoconductors, an electrophotographic photoconductor comprising a complex of 2,4,7-trinitro-9-fluorenone and poly-N-vinylcarbazole is known.

However, while these electrophotographic photoconductors, have many advantages over other conventional electrophotographic photoconductors, at the same time they have several shortcomings from the viewpoint of practical use.

For instance, a selenium photoconductor which is widely used at present has a shortcoming that its production is difficult and, accordingly, its production cost is high, and is difficult to work into the form of a belt due to its poor flexibility. Furthermore, it is so vulnerable to heat and mechanical shock that it must be handled with the utmost care.

In contrast to this, the zinc oxide photoconductor is inexpensive since it can be produced more easily than the selenium photoconductor. Specifically, it can be produced by simply coating inexpensive zinc oxide particles on a support material. However, it is poor in photosensitivity, surface smoothness, hardness, tensile strength and wear resistance. Therefore, it is not suitable for a photoconductor for use in plain paper copiers in which the photoconductor is used in quick repetition.

The photoconductor employing the aforementioned complex of 2,4,7-trinitro-9-fluorenone and poly-N-vinylcarbazole is also poor in photosensitivity and is therefore not suitable for practical use, particularly for a high speed copying machine.

Recently, extensive studies have been done on the electrophotographic photoconductors of the above-mentioned types, in order to eliminate the above-described shortcomings of the conventional photoconductors. In particular, attention has focused on layered organic electrophotographic photoconductors, each comprising an electroconductive support layer, a charge generation layer comprising an organic pigment formed on the electroconductive support layer, and a charge transport layer comprising a charge transport material formed on the charge generation layer, which are for use in plain paper copiers, since such layered organic electrophotoconductors have high photosensitivity and stable charging properties. As a matter of fact, some types of layered electrophotographic photoconductors are being successfully used in practice. Examples of the layered electrophotographic photoconductors are as follows:

(1) U.S. Pat. No. 3,871,882 discloses a layered electrophotographic photoconductor whose charge generation layer comprises a perylene derivative and whose charge transport layer comprises an oxadiazole derivative.

(2) Japanese Laid-open Patent Applications No. 52-55643 and No. 52-72231 disclose a layered electrophotographic photoconductor whose charge generation layer comprises Chlorodiane Blue which is dispersed in an organic amine and coated on an electroconductive support material and whose charge transfer layer comprises a pyrazoline derivative.

(3) Japanese Laid-open Patent Application No. 53-95033 discloses a layered electrophotographic photoconductor whose charge generation layer comprises a carbozole type bisazo pigment dispersed, for instance, in tetrahydrofuran and coated on an electroconductive support material, and whose charge transport layer comprises 2,5-bis(4-diethylaminophenyl)-1,3,4-oxadiazole or TNF.

(4) Japanese Laid-open Patent Application No. 54-12742 discloses a layered electrophotographic photoconductor of the same type as that disclosed in Japanese Laid-open Patent Application No. 53-95033, in which the carbazole type bisazo pigment is replaced by an oxadiazole type bisazo pigment.

(5) Japanese Laid-open Patent Application No. 54-22834 also discloses a layered electrophotographic photoconductor of the same type as that disclosed in Japanese Laid-open Patent Application No. 53-95033, in which the carbazole type bisazo pigment is replaced by a fluorenone type bisazo pigment.

As mentioned previously, these layered electrophotographic photoconductors have many advantages over other electrophotographic photoconductors, but at the same time, they have a variety of shortcomings.

Specifically, the electrophotographic photoconductor (1) employing a perylene derivative and an oxadiazole derivative presents no problem for use in an ordinary electrophotographic copying machine, but its photosensitivity is insufficient for use in a high speed electrophotographic copying machine. Furthermore, since the perylene derivative, which is a charge generation material and has the function of controlling the spectral sensitivity of the photoconductor, does not necessarily have spectral absorbance in the entire visible region, this photoconductor cannot be employed for use in color copiers.

The electrophotographic photoconductor (2) employing Chlorodiane Blue and a pyrazoline derivative exhibits comparatively good photosensitivity. However, when preparing that photoconductor, an organic amine, for example, ethylene diamine, which is difficult to handle, is necessary as a coating solvent for forming the charge generation layer.

The electrophotographic photoconductors (3) through (5), for which the inventors of the present invention applied for patents, have an advantage over other conventional electrophotographic photoconductors in that the charge generation layers can be prepared easily by coating dispersions of fine pigment particles in an organic solvent (with addition of a binder resin thereto when necessary) on an electroconductive support material. However, the photosensitivities of the photoconductors (3) through (5) are so low that that they cannot be used as photoconductors for high speed electrophotographic copiers.

SUMMARY OF THE INVENTION

It is therefore an object of the present invention to provide a layered electrophotographic photoconductor comprising an electroconductive support material and a photoconductive double layer which consists of a charge generation layer and a charge transport layer, with high photosensitivity and uniform spectral absorbance in the visible region, and which gives rise to no difficulty in producing of the electrophotographic photoconductor.

According to the present invention, the charge generation layer comprises a bisazo pigment selected from the group consisting of the bisazo pigments represented by the following general formula (1), and the charge transport layer comprises a charge transport material selected from the group consisting of the anthracene compounds represented by the general formula (2) and distyrylbenzene compounds represented by the general formula (3)

(1)

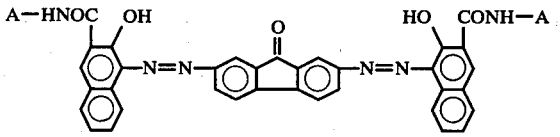

wherein A represents —$C_6H_4$—Cl(o), —$C_6H_4$—Cl(m), —$C_6H_4$—Br(o), —$C_6H_4$—Br(m), —$C_6H_4$—F(o), —$C_6H_4$—F(m), —$C_6H_4$—F(p), or —$C_6H_4$—I(m);

(2)

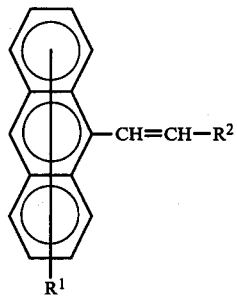

wherein $R^1$ represents hydrogen or halogen; and $R^2$ represents a substituted or unsubstituted phenyl group, a naphthyl group, an anthryl group or a carbazole group.

(3)

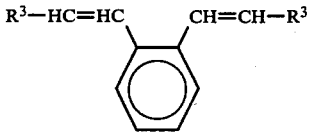

wherein $R^3$ represents a carbazolyl group, a pyridyl group, a thienyl group, an indolyl group, a furyl group, a phenyl group, a styryl group, a naphthyl group, an anthryl group, which phenyl group, styryl group, naphthyl group and anthryl group are unsubstituted or substituted with one member selected from the group consisting of a dialkylamino group, an alkyl group, an alkoxy group, a carboxyl group or an esterified carboxyl group, halogen, a cyano group, an aralkylamino group, an amino group, a hydroxy group, a nitro group and an acetylamino group.

According to the present invention, by the layered construction of the charge generation layer and the charge transport layer, which respectively comprises the above-mentioned charge generating material and the charge transporting material, and by the particular combination of the charge generating material and the charge transporting material, there is provided an electrophotographic photoconductor capable of providing high surface potential in the dark and dissipating the surface potential speedily upon exposure to light and without any substantial change in electrophotographic properties during repeated electrophotographic copying, which copying process includes charging, exposure, development and elimination of latent electrostatic images by charge quenching.

BRIEF DESCRIPTION OF THE DRAWING

In the drawing, the single FIGURE shows an enlarged cross section of a layered electrophotographic photoconductor according to the present invention.

DETAILED DESCRIPTION OF THE PREFERRED EMBODIMENTS

Referring to the single FIGURE, there is shown an enlarged cross section of an embodiment of a layered electrophotographic photoconductor according to the present invention. As shown in this FIGURE, a charge generation layer 22 comprising a charge generating material is formed on an electroconductive support material 11, and a charge transport layer 33 comprising a charge transporting material is formed on the charge generation layer 22. The charge generation layer 22 and charge transport layer 33 constitute a photoconductive layer 44 as shown in the FIGURE.

In the thus formed layered electrophotographic photoconductor, a latent electrostatic image is formed by the following mechanism:

The surface of the layered electrophotographic photoconductor is electrically charged uniformly in the dark, so that electric charges are formed in the surface of the photoconductor. The thus electrically charged photoconductor is then exposed to an optical image. When this exposure is done, the light rays of the optical image pass through the transparent charge transport layer 33 and enter the charge generation layer 22 where the rays of light are then absorbed by the charge generating material present in the charge generation layer 22. Upon absorption of the light rays, the charge generating material generates charge carriers, which are then injected into the charge transport layer 33. The injected charge carriers are transported towards the surface of the photoconductor through the charge transport layer 33, in accordance with the electric field applied thereto by the first mentioned electric charging, so that electric charges present in the surface of the photoconductor are neutralized, whereby a latent electrostatic image is formed on the surface of the photoconductor.

Referring to the FIGURE, the electroconductive support material 11 for use in the present invention can be made of a plate, drum or foil of metals, such as aluminum, nickel or chromium; a plastic film with a thin layer of aluminum, tin oxide, indium, chromium or palladium; or a sheet of paper or plastic film with an electrically conductive material coated thereon, or impregnated with an electrically conductive material.

The charge generation layer 22 is formed on the electroconductive support material 11 by grinding a bisazo pigment, which works as the charge generating material and which is represented by the formula (1), into fine particles, for instance by a ball mill, and dispersing the fine particles of the bisazo pigment in a solvent, if necessary with the addition of a binder resin to the dispersion, and coating that dispersion on the electroconductive support material 11.

(1)

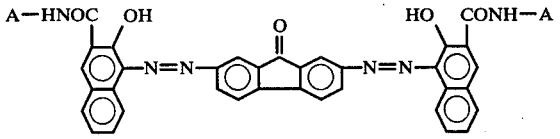

wherein A represents —$C_6H_4$—Cl(o), —$C_6H_4$—Cl(m), —$C_6H_4$—Br(o), —$C_6H_4$—Br(m), —$C_6H_4$—F(o), —$C_6H_4$—F(m), —$C_6H_4$—F(p), or —$C_6H_4$—I(m).

When necessary, the surface of the charge generation layer 22 is made smooth or the thickness of the charge generation layer 22 is adjusted by buffing.

The thickness of the charge generation layer 22 is in the range of 0.01 μm to 5 μm, preferably in the range of 0.05 μm to 2 μm, and the bisazo compound content in the charge generation layer 22 is in the range of 10 weight percent to 100 weight percent, preferably in the range of 30 weight percent to 95 weight percent.

When the thickness of the charge generation layer 22 is less than 0.01 μm, the photosensitivity of the electrophotographic photoconductor is insufficient for practical use, while when the thickness of the charge generation layer 22 is more than 5 μm, the charge retention property of this photoconductor becomes poor. Furthermore, when the content of the bisazo pigment in the charge generation layer 22 is less than 10 weight percent, the photoconductor does not exhibit sufficiently high photosensitivity for practical use.

The charge transport layer 33 is formed on the charge generation layer 22 by coating thereon a tetrahydrofuran solution of a charge transport material selected from a group consisting of the anthracene compounds represented by the general formula (2) and the distyrylbenzene compounds represented by the general formula (3)

(2)

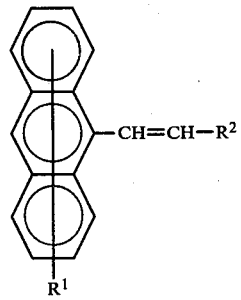

wherein $R^1$ represents hydrogen or halogen; and $R^2$ represents a substituted or unsubstituted phenyl group, a naphthyl group, an anthryl group or a carbazole group;

(3)

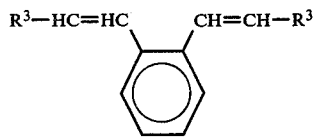

wherein $R^3$ represents a carbazolyl group, a pyridyl group, a thienyl group, an indolyl group, a furyl group, a phenyl group, a styryl group, a naphthyl group, an anthryl group, which phenyl group, styryl group, naphthyl group and anthryl group are unsubstituted or substituted with one member selected from the group consisting of a dialkylamino group, an alkyl group, an alkoxy group, a carboxyl group or an esterified carboxyl group, halogen, a cyano group, an aralkylamino group, an amino group, a hydroxy group, a nitro group and an acetylamino group.

The content of the charge transport material in the charge transport layer 33 is in the range of 10 weight percent to 80 weight percent, preferably in the range of 25 weight percent to 75 weight percent.

The thickness of the charge transport layer 33 is in the range of 2 μm to 100 μm, preferably in the range of 5 μm to 40 μm.

When the content of the charge transport material in the charge transport layer 33 is less than 10 weight percent, the photosensitivity of this photoconductor is poor, while when the content of the charge transport material is more than 80 percent, the charge transport layer 33 becomes brittle or the charge transport material contained in the charge transport layer 33 separates out in the form of crystals, making the charge transport layer 33 opaque and having adverse effects on the electrophotographic properties of the photoconductor.

When the thickness of the charge transport layer 33 is less than 5 μm, the surface potential cannot be retained properly, while when the thickness of the charge transport layer 33 is more than 40 μm, the residual potential of the photoconductor tends to become too high for practical use.

As the binder resin for use in the charge generation layer 22, a polyester resin, a butyral resin, an ethyl cellulose resin, an epoxy resin, an acrylic resin, a polyvinylidene resin, polystyrene, polybutadiene chloride resin and copolymers of those resins can be used individually or in combinations thereof.

As the binder resin for use in the charge transport layer 33, a polycarbonate resin, a polyester resin, polystyrene, polybutadiene, a polyurethane resin, an epoxy resin, an acrylic resin, a silicone resin and copolymers of those resins can be used individually or in combinations thereof.

Furthermore, in order to improve the flexibility and mechanical strength of the charge transport layer 33, a variety of additives, such as halogenated paraffin, dialkyl phthalate and silicone oil can be added to the charge transport layer 33.

In the present invention, when necessary, a barrier layer can be interposed between the electroconductive support material 11 and the charge generation layer 22, an intermediate layer between the charge generation layer 22 and the charge transport layer 33, or an overcoat layer on top of the charge transport layer 33.

In the present invention, the following bisazo compounds are particularly useful, which are represented by the previously described general formula (1), in combination with one of the following anthracene compounds represented by the previously described general formula (2) or one of the distyrylbenzene compounds represented by the previously described general formula (3) in the above-described layered photoconductor.

Bisazo Compounds

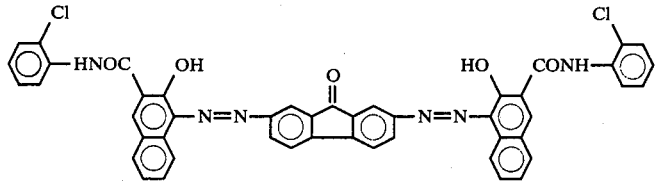

(1-1)

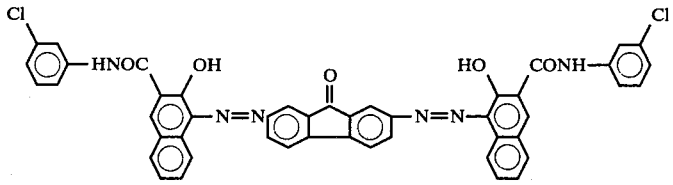

(1-2)

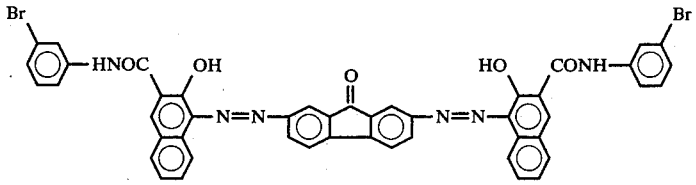

(1-3)

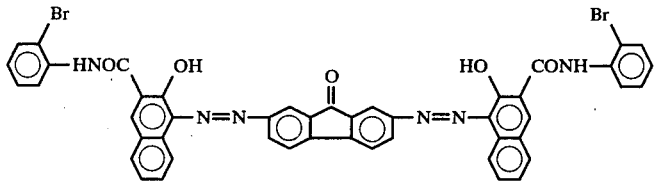

(1-4)

-continued
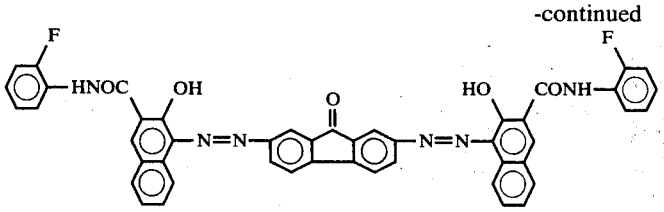
(1-5)
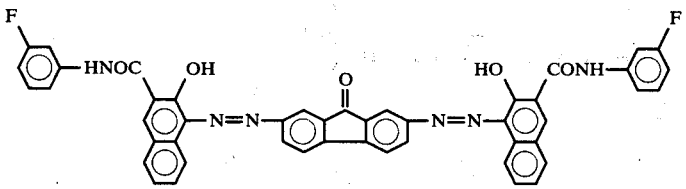
(1-6)
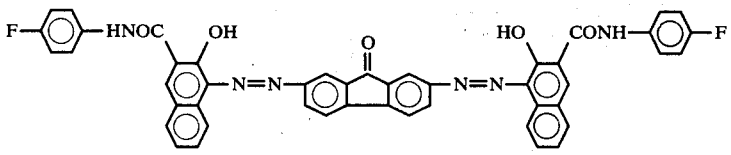
(1-7)
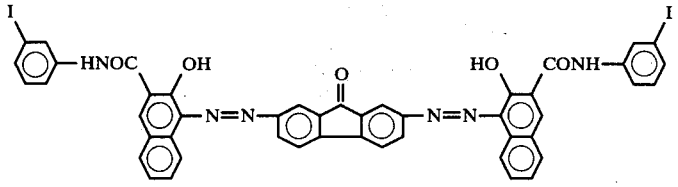
(1-8)
Anthracene Compounds
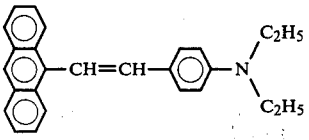
(2-1)
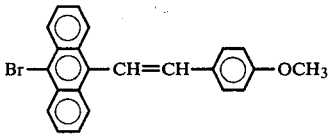
(2-2)
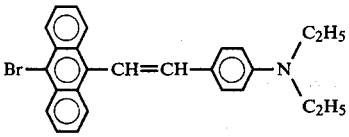
(2-3)
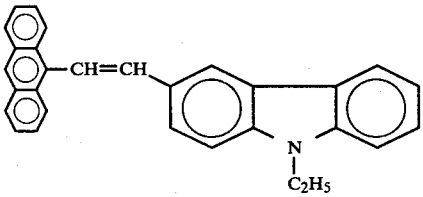
(2-4)
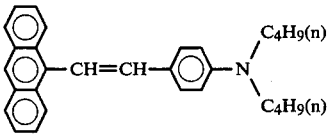
(2-5)
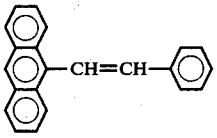
(2-6)
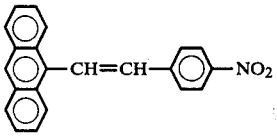
(2-7)
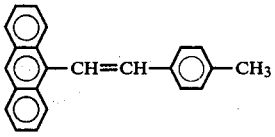
(2-8)
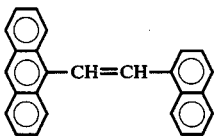
(2-9)
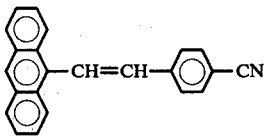
(2-10)

-continued
(2-11)
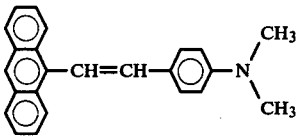
(2-12)
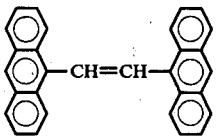
(2-13)
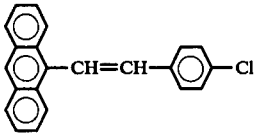
(2-14)
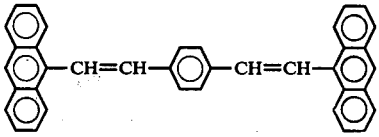
(2-15)
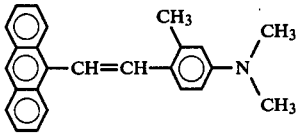
(2-16)
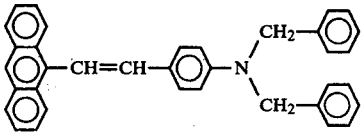
(2-17)
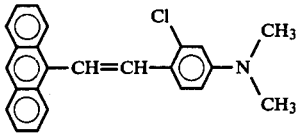
(2-18)
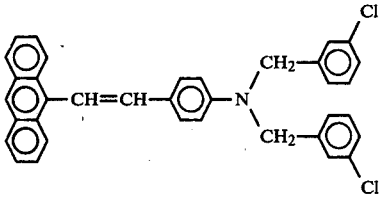
Distyrylbenzene Compounds
Hereinafter, R—HC=HC 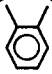 CH=CH—R is shown by 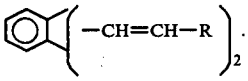 .
(3-1)
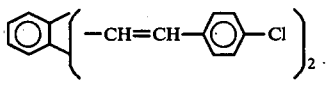
(3-2)
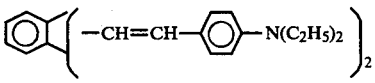
(3-3)
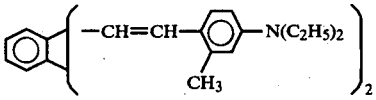
(3-4)
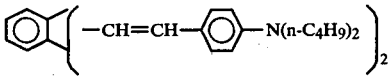
(3-5)
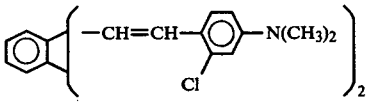
(3-6)
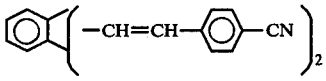
(3-7)
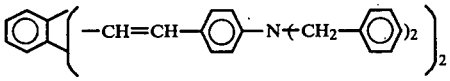
(3-8)
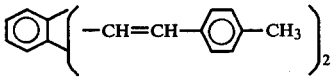
(3-9)
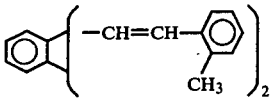
(3-10)
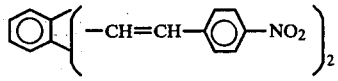
(3-11)
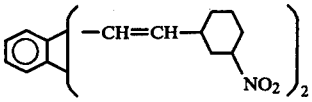
(3-12)
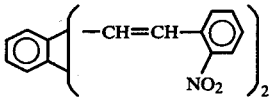

-continued
(3-13)
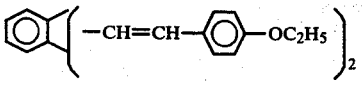
(3-14)
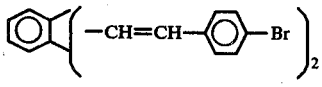
(3-15)
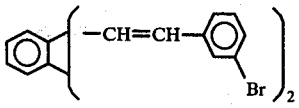
(3-16)
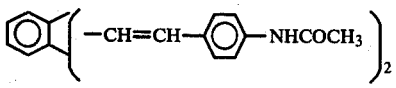
(3-17)
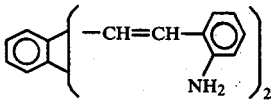
(3-18)
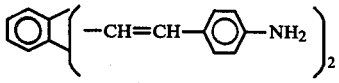
(3-19)
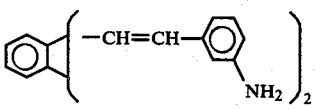
(3-20)
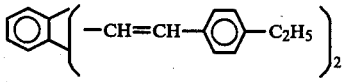
(3-21)
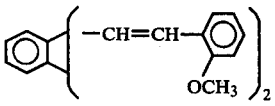
(3-22)
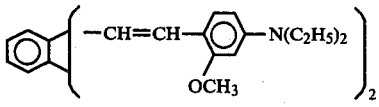
(3-23)
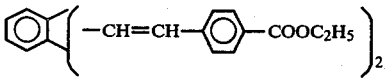
(3-24)
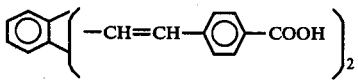
(3-25)
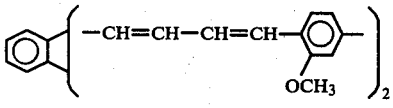
(3-26)
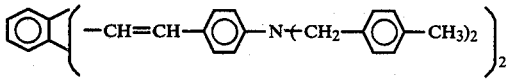
(3-27)
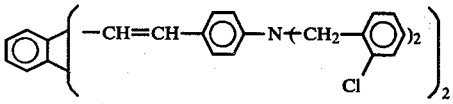
(3-28)
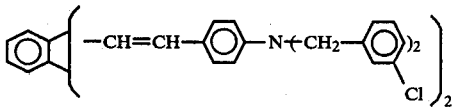
(3-29)
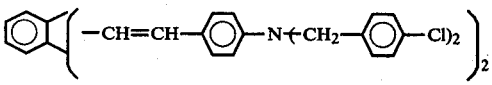
(3-30)
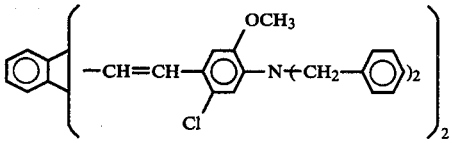
(3-31)
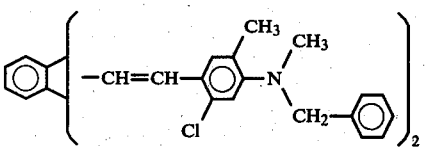
(3-32)
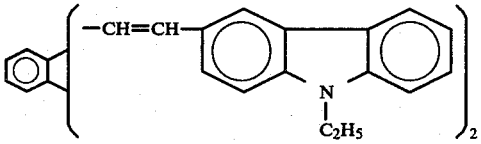
(3-33)
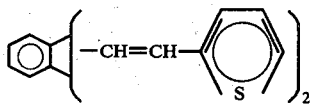
(3-34)
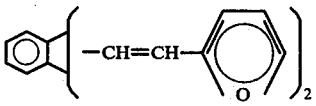
(3-35)
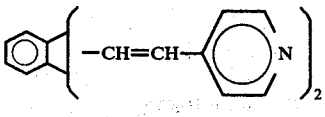
(3-36)
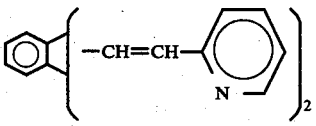

-continued (3-37)

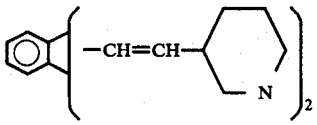

(3-38)

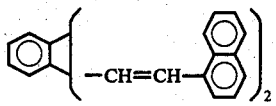

(3-39)

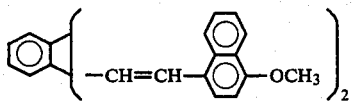

(3-40)

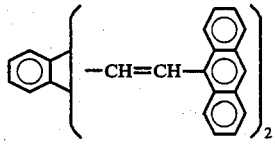

(3-41)

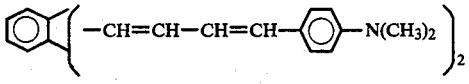

(3-42)

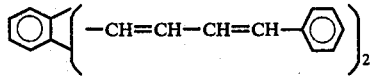

(3-43)

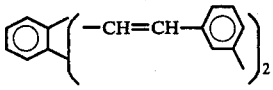

(3-44)

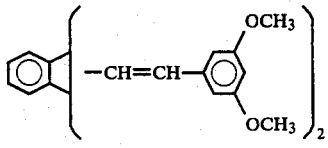

(3-45)

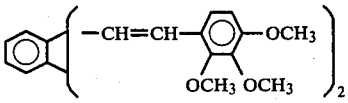

(3-46)

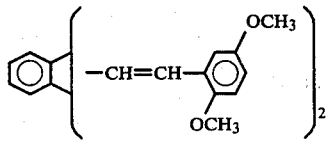

(3-47)

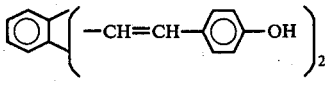

(3-48)

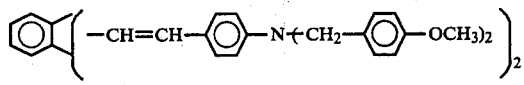

(3-49)

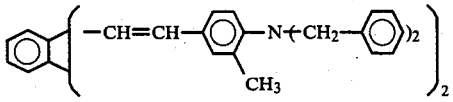

(3-50)

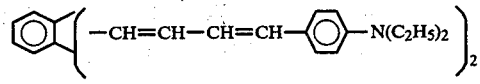

(3-51)

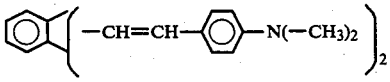

Embodiments of a layered electrophotographic photoconductor according to the present invention will now be explained.

Example 1 (Layered Photoconductor No. 1-1)

One part by weight of a bisazo compound represented by the formula (1-1), 19 parts by weight of tetrahydrofuran, and 6 parts by weight of a tetrahydrofuran solution of a polyvinyl butyral resin (Trade name: Denka Butyral #4000-1 made by Denki Kagaku Kogyo Company, Ltd.) (5 weight percent) were ground in a ball mill.

To the thus ground mixture was added, with slot stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 1.0 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 19.1 μm was formed on the charge generation layer, whereby a layered electrophotographic photoconductor No. 1-1 was prepared.

Example 2 (Layered Photoconductor No. 1-2)

Example 1 was repeated except that anthracene compound (2-1) was replaced with anthracene compound (2-11), so that a layered electrophotographic photoconductor No. 1-2 with a charge generation layer with a thickness of 1.0 μm and a charge transport layer with a thickness of 18.6 μm was prepared.

Example 3 (Layered Photoconductor No. 1-3)

Example 1 was repeated except that anthracene compound (2-1) was replaced with anthracene compound (2-15), so that a layered electrophotographic photoconductor No. 1-3 with a charge generation layer with a thickness of 1.0 μm and a charge transport layer with a thickness of 18.3 μm was prepared.

Example 4 (Layered Photoconductor No. 1-4)

Example 1 was repeated that the polyvinyl butyral resin was replaced with a polyester resin (Trade Name: Vylon 200 made by Toyobo Co., Ltd.), so that a layered electrophotographic photoconductor No. 1-4 with a charge generation layer with a thickness of 1.0 μm and a charge transport layer with a thickness of 18.5 μm was prepared.

Example 5 (Layered Photoconductor No. 2-1)

One part by weight of a bisazo compound represented by the formula (1-2), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.7 μm was formed on the charge generation layer, whereby a layered electrophotographic photoconductor No. 2-1 was prepared.

Example 6 (Layered Photoconductor No. 2-2)

Example 5 was repeated except that anthracene compound (2-1) was replaced with anthracene compound (2-11), and the polyester resin was replaced with a polyvinyl butyral resin (Trade Name: Denka Butyral #4000-1 made by Denki Kagaku Kogyo Co., Ltd.), so that a layered electrophotographic photoconductor No. 2-2 with a charge generation layer with a thickness of 0.9 μm and a charge transport layer with a thickness of 18.5 μm was prepared.

Example 7 (Layered Photoconductor No. 2-3)

Example 6 was repeated except that anthracene compound (2-11) was replaced with anthracene compound (2-15), so that a layered electrophotographic photoconductor No. 2-3 with a charge generation layer with a thickness of 0.9 μm and a charge transport layer with a thickness of 18.3 μm was prepared.

Example 8 (Layered Photoconductor 2-4)

Example 5 was repeated except that the polyester resin was replaced with a polyvinyl butyral resin (Trade Name: Denka Butyral #4000-1 made by Denki Kagaku Kogyo Co., Ltd.), so that a layered electrophotographic photoconductor No. 2-4 with a charge generation layer with a thickness of 0.9 μm and a charge transport layer with a thickness of 19.0 μm was prepared.

Example 9 (Layered Photoconductor No. 3-1)

One part by weight of a bisazo compound represented by the formula (1-3), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 15.3 μm was formed on the charge generation layer, whereby a layered electrophotographic photoconductor No. 3-1 was prepared.

Example 10 (Layered Photoconductor No. 3-2)

Example 9 was repeated except that anthracene compound (2-1) was replaced with anthracene compound (2-11), and the polyester resin was replaced with a polyvinyl butyral resin (Trade Name: XYHL made by Union Carbide Plastic Company), so that a layered electrophotographic photoconductor No. 3-2 with a charge generation layer with a thickness of 0.9 μm and a charge transport layer with a thickness of 18.0 μm was prepared.

Example 11 (Layered Photoconductor No. 3-3)

Example 10 was repeated except that anthracene compound (2-11) was replaced with anthracene compound (2-15), so that a layered electrophotographic photoconductor No. 3-3 with a charge generation layer with a thickness of 0.9 μm and a charge transport layer with a thickness of 18.4 μm was prepared.

Example 12 (Layered Photoconductor No. 4-1)

One part by weight of a bisazo compound represented by the formula (1-4), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 part by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 20.0 μm was formed on the charge generation layer, whereby a layered electrophotographic photoconductor No. 4-1 was prepared.

Example 13 (Layered Photoconductor No. 4-2)

Example 12 was repeated except that anthracene compound (2-1) was replaced with anthracene compound (2-11) and the polyester resin was replaced with a polyvinyl butyral resin (Trade Name: XYHL made by Union Carbide Plastic Company), so that a layered electrophotographic photoconductor No. 4-2 with a charge generation layer with a thickness of 0.8 μm and a charge transport layer with a thickness of 19.7 μm was prepared.

Example 14 (Layered Photoconductor No. 4-3)

Example 13 was repeated except that anthracene compound (2-11) was replaced with anthracene compound (2-15), so that a layered electrophotographic photoconductor No. 4-3 with a charge generation layer with a thickness of 0.9 μm and a charge transport layer with a thickness of 19.0 μm was prepared.

Example 15 (Layered Photoconductor No. 5-1)

One part by weight of a bisazo compound represented by the formula (1-5), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.7 μm was formed on the charge generation layer, whereby a layered electrophotographic photoconductor No. 5-1 was prepared.

Example 16 (Layered Photoconductor No. 5-2)

Example 15 was repeated except that anthracene compound (2-1) was replaced with anthracene compound (2-11) and the polyester resin was replaced with a polyvinyl butyral resin (Trade Name: XYHL made by Union Carbide Plastic Company), so that a layered electrophotographic photoconductor No. 5-2 with a charge generation layer with a thickness of 0.9 μm and a charge transport layer with a thickness of 18.5 μm was prepared.

Example 17 (Layered Photoconductor No. 5-3)

Example 16 was repeated except that anthracene compound (2-11) was replaced with anthracne compound (2-15), so that a layered electrophotographic photoconductor No. 5-3 with a charge generation layer with a thickness of 0.9 μm and a charge transport layer with a thickness of 18.4 μm was prepared.

Example 18 (Layered Photoconductor No. 5-4)

Example 15 was repeated except that the polyester resin was replaced with a polyvinyl butyral resin (Trade Name: XYHX made by Union Carbide Plastic Company), so that a layered electrophotographic photoconductor No. 5-4 with a charge generation layer with a thickness of 0.9 μm and a charge transport layer with a thickness of 18.8 μm was prepared.

Example 19 (Layered Photoconductor No. 6-1)

One part by weight of a bisazo compound represented by the formula (1-6), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 19.7 μm was formed on the charge generation layer, whereby a layered electrophotographic photoconductor No. 6-1 was prepared.

Example 20 (Layered Photoconductor No. 6-2)

Example 19 was repeated except that anthracene compound (2-1) was replaced with anthracene compound (2-11) and the polyester resin was replaced with a polyvinyl butyral resin (Trade Name: XYHL made by Union Carbide Plastic Company), so that a layered electrophotographic photoconductor No. 6-2 with a charge generation layer with a thickness of 0.9 μm and a charge transport layer with a thickness of 18.6 μm was prepared.

Example 21 (Layered Photoconductor No. 6-3)

Example 20 was repeated except that anthracene compound (2-11) was replaced with anthracene compound (2-15), so that a layered electrophotographic photoconductor No. 6-3 with a charge generation layer with a thickness of 0.9 μm and a charge transport layer with a thickness of 18.1 m was prepared.

Example 22 (Layered Photoconductor No. 7-1)

One part by weight of a bisazo compound represented by the formula (1-7), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 14.3 μm was formed on the charge generation layer, whereby a layered electrophotographic photoconductor No. 7-1 was prepared.

Example 23 (Layered Photoconductor No. 7-2)

Example 22 was repeated except that anthracene compound (2-1) was replaced with anthracene compound (2-11), so that a layered electrophotographic photoconductor No. 7-2 with a charge generation layer with a thickness of 0.9 μm and a charge transport layer with a thickness of 19.0 μm was prepared.

Example 24 (Layered Photoconductor No. 7-3)

Example 22 was repeated except that anthracene compound (2-1) was replaced with anthracene compound (2-15), so that a layered electrophotographic photoconductor No. 7-3 with a charge generation layer with a thickness of 0.9 μm and a charge transport layer with a thickness of 17.6 μm was prepared.

Example 25 (Layered Photoconductor No. 7-4)

Example 22 was repeated except that the polyester resin was replaced with a polyvinyl butyral resin (Trade Name: XYHX made by Union Carbide Plastic Company), so that a layered electrophotographic photoconductor No. 7-4 with a charge generation layer with a thickness of 0.9 μm and a charge transport layer with a thickness of 16.4 μm was prepared.

Example 26 (Layered Photoconductor No. 8-1)

One part by weight of a bisazo compound represented by the formula (1-8), 19 parts by weight of tetrahydrofuran, and 6 parts by weight of a tetrahydrofuran solution of a polyester resin (Trade Name: Vylon 200 made by Toyobo Co., Ltd.) (5 weight percent) were ground in a ball mill.

To the thus ground mixture was added 104 parts by weight of tetrahydrofuran while stirring slowly. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of anthracene compound (2-1), 10 parts by weight of a polycarbonate resin (Trade Name: Panlite K-1300 made by Teijin Limited) and 0.002 parts by weight of silicone oil (Trade Name: KF-50 made by The Shin-Etsu Chemical Co., Ltd.) were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.9 μm was formed on the charge generation layer, whereby a layered electrophotographic photoconductor No. 8-1 was prepared.

Example 27 (Layered Photoconductor No. 8-2)

Example 26 was repeated except that anthracene compound (2-1) was replaced with anthrancene compound (2-11) and the polyester resin was replaced with a polyvinyl butyral resin (Trade Name: XYHL made by Union Carbide Plastic Company), so that a layered electrophotographic photoconductor No. 8-2 with a charge generation layer with a thickness of 0.9 μm and a charge transport layer with a thickness of 18.4 μm was prepared.

Example 28 (Layered Photoconductor No. 8-3)

Example 27 was repeated except that anthracene compound (2-11) was replaced with anthracene compound (2-15), so that a layered electrophotographic photoconductor No. 8-3 with a charge generation layer with a thickness of 0.9 μm and a charge transport layer with a thickness of 18.4 μm was prepered.

Example 29 (Layered Photoconductor No. 8-4)

Example 26 was repeated except that the polyester resin was replaced with a polyvinyl butyral resin (Trade Name: XYHX made by Union Carbide Plastic Company), so that a layered electrophotographic photoconductor No. 8-4 with a charge generation layer with a thickness of 0.9 μm and a charge transport layer with a thickness of 18.2 μm was prepared.

Example 30 (Layered Photoconductor No. 9-1)

One part by weight of a bisazo compound represented by the formula (1-1), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.4 μm was formed on the charge generation layer, whereby a layered electrophotographic photoconductor No. 9-1 was prepared.

Example 31 (Layered Photoconductor No. 9-2 )

Example 30 was repeated except that distyrylbenzene compound (3-2) was replaced with distyrylbenzene compound (3-7), so that a layered electrophotographic photoconductor No. 9-2 with a charge generation layer with a thickness of 0.9 μm and a charge transport layer with a thickness of 18.0 μm was prepared.

Example 32 (Layered Photoconductor No. 9-3)

Example 31 was repeated except that the polyvinyl butyral resin was replaced with a polyester resin (Trade Name: Vylon 200 made by Toyobo Co., Ltd.), so that a layered electrophotographic photoconductor No. 9-3 with a charge generation layer with a thickness of 0.9 μm and a charge transport layer with a thickness of 18.2 μm was prepared.

Example 33 (Layered Photoconductor No. 10-1)

One part by weight of a bisazo compound represented by the formula (1-2), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.6 μm was formed on the charge generation layer, whereby a layered electrophotographic photoconductor No. 10-1 was prepared.

Example 34 (Layered Photoconductor No. 10-2)

Example 33 was repeated except that distyrylbenzene compound (3-2) was replaced with distyrylbenzene compound (3-7), so that a layered electrophotographic photoconductor No. 10-2 with a charge generation layer with a thickness of 0.9 μm and a charge transport layer with a thickness of 18.2 μm was prepared.

Example 35 (Layered Photoconductor No. 10-3)

Example 34 was repeated except that the polyvinyl butyral resin was replaced with a polyester resin (Trade Name: Vylon 200 made by Toyobo Co., Ltd.), so that a layered electrophotographic photoconductor No. 10-3 with a charge generation layer with a thickness of 0.9 μm and a charge transport layer with a thickness of 18.4 μm was prepared.

Example 36 (Layered Photoconductor No. 11-1)

One part by weight of a bisazo compound represented by the formula (1-3), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.1 μm was formed on the charge generation layer, whereby a layered electrophotographic photoconductor No. 11-1 was prepared.

Example 37 (Layered Photoconductor No. 11-2)

Example 36 was repeated except that distyrylbenzene compound (3-2) was replaced with distyrylbenzene compound (3-7), so that a layered electrophotoraphic photoconductor No. 11-2 with a charge generation layer with a thickness of 1.0 μm and a charge transport layer with a thickness of 17.9 μm was prepared.

Example 38 (Layered Photoconductor No. 12-1)

One part by weight of a bisazo compound represented by the formula (1-4), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 23.0 μm was formed on the charge generation layer, whereby a layered electrophotographic photoconductor No. 12-1 was prepared.

Example 39 (Layered Photoconductor No. 12-2)

Example 38 was repeated except that distyrylbenzene compound (3-2) was replaced with distyrylbenzene compound (3-7), so that a layered electrophotographic photoconductor No. 4-2 with a charge generation layer with a thickness of 0.9 μm and a charge transport layer with a thickness of 22.5 μm was prepared.

Example 40 (Layered Photoconductor No. 12-3)

Example 39 was repeated except that the polyvinyl butyral resin was replaced with a polyester resin (Trade Name: Vylon 200 made by Toyobo Co., Ltd.), so that a layered electrophotographic photoconductor No. 12-3 with a charge generation layer with a thickness of 0.9 μm and a charge transport layer with a thickness of 22.7 μm was prepared.

Example 41 (Layered Photoconductor No. 13-1)

One part by weight of a bisazo compound represented by the formula (1-5), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.8 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 19.1 μm was formed on the charge generation layer, whereby a layered electrophotographic photoconductor No. 13-1 was prepared.

Example 42 (Layered Photoconductor No. 13-2)

Example 41 was repeated except that distyrylbenzene compound (3-2) was replaced with distyrylbenzene compound (3-7), so that a layered electrophotographic photoconductor No. 13-2 with a charge generation layer with a thickness of 0.8 μm and a charge transport layer with a thickness of 18.7 μm was prepared.

Example 43 (Layered Photoconductor No. 13-3)

Example 42 was repeated except that the polyvinyl butyral resin was replaced with a polyester resin (Trade Name: Vylon 200 made by Toyobo Co., Ltd.), so that a layered electrophotographic photoconductor No. 13-3 with a charge generation layer with a thickness of 0.8 μm and a charge transport layer with a thickness of 18.6 μm was prepared.

Example 44 (Layered Photoconductor No. 14-1)

One part by weight of a bisazo compound represented by the formula (1-6), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture were added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.8 μm was formed on the charge generation layer, whereby a layered electrophotographic photoconductor No. 14-1 was prepared.

Example 45 (Layered Photoconductor No. 14-2)

Example 44 was repeated except that distyrylbenzene compound (3-2) was replaced with distyrylbenzene compound (3-7), so that a layered electrophotographic photoconductor No. 14-2 with a charge generation layer with a thickness of 0.9 μm and a charge transport layer with a thickness of 19.2 μm was prepared.

Example 46 (Layered Photoconductor No. 15-1)

One part by weight of a bisazo compound represented by the formula (1-7), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name: KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 20.9 μm was formed on the charge generation layer, whereby a layered electrophotograhic photoconductor No. 15-1 was prepared.

Example 47 (Layered Photoconductor No. 15-2)

Example 46 was repeated except that distyrylbenzene compound (3-2) was replaced with distyrylbenzene compound (3-7), so that a layered electrophotographic photoconductor No. 15-2 with a charge generation layer with a thickness of 0.9 μm and a charge transport layer with a thickness of 18.9 μm was prepared.

Example 48 (Layered Photoconductor No. 15-3)

Example 47 was repeated except that the polyvinyl butyral resin was replaced with a polyester resin (Trade Name: Vylon 200 made by Toyobo Co., Ltd.), so that a layered electrophotographic photoconductor No. 15-3 with a charge generation layer with a thickness of 0.9 μm and a charge transport layer with a thickness of 19.7 μm was prepared.

Example 49 (Layered Photoconductor No. 16-1)

One part by weight of a bisazo compound represented by the formula (1-8), 19 parts by weight of tetrahydrofuran, and 6 parts by weight of a tetrahydrofuran solution of a polyvinyl butyral resin (Trade name: XYHL made by Union Carbide Plastics Company) (5 weight percent) were ground in a ball mill.

To the thus ground mixture was added, with slow stirring, 104 parts by weight of tetrahydrofuran. The thus prepared dispersion was coated on the aluminum surface side of an aluminum-evaporated polyester film by a doctor blade, with a wet gap of 35 μm, and was then dried at 80° C. for 5 minutes, whereby a charge generation layer with a thickness of 0.9 μm was formed on the aluminum-evaporated polyester film.

Furthermore, 10 parts by weight of distyrylbenzene compound (3-2), 10 parts by weight of a polycarbonate resin (Trade Name: Panlite K-1300 made by Teijin Limited), 0.002 parts by weight of silicone oil (Trade Name-KF-50 made by The Shin-Etsu Chemical Co., Ltd.) and 80 parts by weight of tetrahydrofuran were mixed to form a solution. This solution was coated on the charge generation layer by a doctor blade with a wet gap of 200 μm and was then dried at 80° C. for 2 minutes and then at 100° C. for 5 minutes, so that a charge transport layer with a thickness of 18.7 μm was formed on the charge generation layer, whereby a layered electrophotographic photoconductor No. 16-1 was prepared.

Example 50 (Layered Photoconductor No. 16-2)

Example 49 was repeated except that distyrylbenzene compound (3-2) was replaced with distyrylbenzene compound (3-7), so that a layered electrophotographic photoconductor No. 16-2 with a charge generation layer with a thickness of 0.9 μm and a charge transport layer with a thickness of 19.1 μm was prepared.

Example 51 (Layered Photoconductor No. 16-3)

Example 50 was repeated except that the polyvinyl butyral resin was replaced with a polyester resin (Trade Name: Vylon 200 made by Toyobo Co., Ltd.), so that a layered electrophotographic photoconductor No. 16-3 with a charge generation layer with a thickness of 0.9 μm and a charge transport layer with a thickness of 18.5 μm was prepared.

The thus prepared electrophotographic photoconductors were each charged negatively in the dark under application of −6 kV of corona charge for 20 seconds and the surface potential Vs (Volt) of each photoconductor was measured by a Paper Analyzer (Kawaguchi Works, Model SP-428). Each photoconductor was then allowed to stand in the dark for 20 seconds without applying any charge thereto, and the surface potential Vo (Volt) of the photoconductor was measured by the Paper Analyzer. Each photoconductor was then illuminated by a tungsten lamp in such a manner that the illuminance on the illuminated surface of the photoconductor was 20 lux, and the exposure E1/2 (lux second) required to reduce the initial surface potential Vo (Volt) to ½ was measured. The exposure E1/10 (lux second) required to reduce the initial surface potential Vo (Volt) to 1/10 was also measured. The results are shown in Table 1.

In order to illustrate the advantages of the present invention, the following comparative layered photoconductors were prepared:

Comparative Example 1 (Comparative Layered Photoconductor No. 1)

In a vacuum chamber with a vacuum degree of $10^{-5}$ mmHg, an aluminum base plate was placed above N,N'-dimethylperylene-3,4,9,10-tetracarboxylidiimide, which served as a charge generating material, in an evaporation source. The N,N'-dimethylperylene-3,4,9,10-tetracarboxyldiimide was heated to 350° C. and evaporation was permitted to continue for 3 minutes to form a charge generation layer on the aluminum base plate.

A solution consisting of 5 parts by weight of 2,5-bis(4-diethylaminophenyl)-1,3,4-oxadiazole, 5 parts by weight of a polyester resin (Trade Name: Polyester Adhesive 49000 manufactured by Du Pont) and 90 parts by weight of tetrahydrofuran) was coated on the charge generation layer and was dried at 120° C. for 5 minutes, so that a charge transport layer with a thickness of about 10 μm was formed on the charge generation layer, whereby a comparative layered photoconductor No. 1 was prepared.

Comparative Example 2 (Comparative Layered Photoconductor No. 2)

1.08 parts by weight of Chlorodiane Blue (a benzidine type pigment), which served as a charge generating material, was dissolved in 24.46 parts by weight of ethylenediamine. To this solution was added 20.08 parts by weight of n-butylamine with stirring and 54.36 parts by weight of tetrahydrofuran was then added, whereby a charge generation layer coating liquid was prepared. The charge generation layer coating liquid was coated on the aluminum surface side of an aluminum-evaporated film by a doctor blade, and was then dried at 80° C. for 5 minutes, whereby a charge generation layer with a thickness of about 0.5 μm was formed on the aluminum-evaporated polyester film.

A solution of 1 part by weight of 1-phenyl-3-(4-diethylaminostyryl)-5-(4-diethylaminophenyl)-pyrazoline, 1 part by weight of polycarbonate resin (Trade Name: Panlite L-1300 made by Teijin Limited) and 8 parts by weight of tetrahydrofuran was coated on the above-described charge generation layer by a doctor blade and then dried at 80° C. for 2 minutes and then at 100° C. for 5 minutes, so that a charge transport layer with a thickness of 20 μm was formed on the charge generation layer, whereby a comparative layered photoconductor No. 2 was prepared.

Comparative Example 3 (Comparative Layered Photoconductor No. 3)

Two parts by weight of 2,7-bis[2-hydroxy-3-(2,4,-dimethoxy-5-chlorophenylcarbamoyl)-1-naphthylazol]-9-fluorenone, which served as charge generating material, and 98 parts by weight of tetrahydrofuran were ground in a ball mill to form a dispersion. This dispersion was coated on the aluminum surface side of an aluminum-evaporated polyester film by a doctor blade and was then dried at room temperature, whereby a charge generation layer with a thickness of 1 μm was formed on the aluminum-evaporated polyester film.

Two parts by weight of 2,5-bis(4-diethylaminophenyl)-1,3,4-oxadiazole, 2 parts by weight of a polycarbonate resin (Trade Name: Panlite L made by Teijin Limited) and 46 parts by weight of tetrahydrofuran were mixed to obtain a charge transport layer coating solution. This solution was coated on the above-described charge generation layer by a doctor blade and was then dried at 120° C. for 10 minutes, so that a charge transport layer with a thickness of 10 μm was formed on the charge generation layer, whereby a comparative layered photoconductor No. 3 was prepared.

Comparative Example 4 (Comparative Layered Photoconductor No. 4)

One part by weight of a polyester resin (Trade Name: Polyester Adhesive 49000 made by Du Pont), 1 part by weight of 2,7-bis[2-hydroxy-3(4-chlorophenylcarbamoyl)-1-naphthylazol]-9-fluorenone, which was a fluorenone type bisazo pigment, and 26 parts by weight of tetrahydrofuran were ground in a ball mill to obtain a dispersion.

This dispersion was coated on the aluminum surface side of an aluminum-evaporated polyester film by a doctor blade and was then dried at 100° C. for 10 minutes to form a photoconductive layer with a thickness of 7 μm on the aluminum-evaporated polyester film, whereby a comparative layered photoconductor No. 4 was prepared.

The electrostatic characteristics of those comparative photoconductors were measured under the conditions stated in the examples of the electrophotographic photoconductors according to the present invention. The results are shown in Table 2.

TABLE 1

| Photoconductor | Vpo (Volt) | $E_{\frac{1}{2}}$ (lux · sec) | E1/10 (lux · sec) |
|---|---|---|---|
| No. 1-1 | −741 | 1.0 | 2.0 |
| No. 1-2 | −817 | 1.2 | 2.4 |
| No. 1-3 | −831 | 1.2 | 2.5 |
| No. 1-4 | −732 | 0.9 | 1.8 |
| No. 2-1 | −664 | 1.1 | 2.5 |
| No. 2-2 | −765 | 1.3 | 3.1 |
| No. 2-3 | −772 | 1.3 | 3.2 |
| No. 2-4 | −694 | 1.2 | 2.7 |
| No. 3-1 | −591 | 1.1 | 2.5 |
| No. 3-2 | −730 | 1.5 | 2.9 |
| No. 3-3 | −753 | 1.7 | 3.2 |
| No. 4-1 | −523 | 1.3 | 4.4 |
| No. 4-2 | −577 | 1.5 | 5.0 |
| No. 4-3 | −600 | 1.5 | 5.0 |
| No. 5-1 | −731 | 2.2 | 4.3 |
| No. 5-2 | −872 | 2.4 | 4.8 |
| No. 5-3 | −852 | 2.4 | 4.9 |
| No. 5-4 | −807 | 2.3 | 4.6 |
| No. 6-1 | −593 | 1.5 | 3.1 |
| No. 6-2 | −651 | 1.9 | 4.1 |
| No. 6-3 | −679 | 2.0 | 4.3 |
| No. 7-1 | −556 | 1.6 | 3.3 |

TABLE 1-continued

| Photoconductor | Vpo (Volt) | $E_{\frac{1}{2}}$ (lux · sec) | E1/10 (lux · sec) |
|---|---|---|---|
| No. 7-2 | −817 | 1.9 | 4.0 |
| No. 7-3 | −800 | 1.9 | 4.1 |
| No. 7-4 | −650 | 1.7 | 3.7 |
| No. 8-1 | −391 | 1.2 | 3.1 |
| No. 8-2 | −437 | 1.4 | 3.3 |
| No. 8-3 | −478 | 1.4 | 3.4 |
| No. 8-4 | −412 | 1.3 | 3.2 |
| No. 9-1 | −191 | 0.4 | 1.1 |
| No. 9-2 | −584 | 0.7 | 1.4 |
| No. 9-3 | −576 | 0.7 | 1.3 |
| No. 10-1 | −182 | 0.6 | 1.3 |
| No. 10-2 | −532 | 0.9 | 2.0 |
| No. 10-3 | −527 | 0.9 | 1.9 |
| No. 11-1 | −173 | 0.6 | 1.3 |
| No. 11-2 | −528 | 0.7 | 1.5 |
| No. 12-1 | −200 | 0.7 | 1.5 |
| No. 12-2 | −595 | 1.0 | 2.0 |
| No. 12-3 | −576 | 0.9 | 1.8 |
| No. 13-1 | −232 | 1.1 | 2.4 |
| No. 13-2 | −574 | 1.8 | 3.9 |
| No. 13-3 | −568 | 1.7 | 3.6 |
| No. 14-1 | −534 | 0.9 | 1.8 |
| No. 14-2 | −517 | 1.1 | 2.0 |
| No. 15-1 | −217 | 1.0 | 2.1 |
| No. 15-2 | −613 | 1.3 | 2.7 |
| No. 15-3 | −623 | 1.2 | 2.4 |
| No. 16-1 | −175 | 0.6 | 1.5 |
| No. 16-2 | −523 | 0.9 | 2.0 |
| No. 16-3 | −502 | 0.9 | 1.9 |

TABLE 2

| Comparative Photoconductor | Vpo (Volt) | $E_{\frac{1}{2}}$ (lux · sec) | E1/10 (lux · sec) |
|---|---|---|---|
| No. 1 | −960 | 5.4 | 27.0 |
| No. 2 | −603 | 1.9 | 4.1 |
| No. 3 | −993 | 5.1 | 11.0 |
| No. 4 | −114 | 9.6 | 39.2 |

As can be seen from Table 1 and Table 2, the layered electrophotographic photoconductors according to the present invention have a higher photosensensitivity and a lower residual surface potential than the comparative photoconductors No. 1 through No. 4.

The photoconductors according to the present invention were each mounted in a commercially available electrophotographic copying machine Ricopy P-500 (made by Ricoh Company, Ltd.) and copying was repeated 10,000 times. Clear copies were made by all the layered photoconductors according to the present invention. This demonstrated that those photoconductors had also excellent durability in repeated use.

What is claimed is:

1. In a layered electrophotographic photoconductor comprising an electroconductive support material and a photoconductive double layer which consists of a charge generation layer and a charge transport layer, the improvement wherein:

a. said charge generation layer comprises a charge generating material selected from the group consisting of bisazo pigments represented by formula (1)

(1)

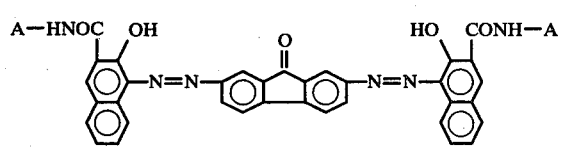

wherein A represents—$C_6H_4$—Cl(o), —$C_6H_4$—Cl(m), —$C_6H_4$—Br(o), —$C_6H_4$—Br(m), —$C_6H_4$—F(o), —$C_6H_4$—F(m), —$C_6H_4$—F(p), or —$C_6H_4$—I(m); and b. said charge transport layer comprises a charge transporting material selected from the group consisting of the anthracene compounds represented by formula (2) and distyrylbenzene compounds represented by formula (3)

(2)

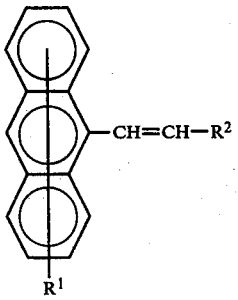

wherein $R^1$ represents hydrogen or halogen; and $R^2$ represents a substituted or unsubstituted phenyl group, a naphthyl group, an anthryl group or a carbazole group, (3)

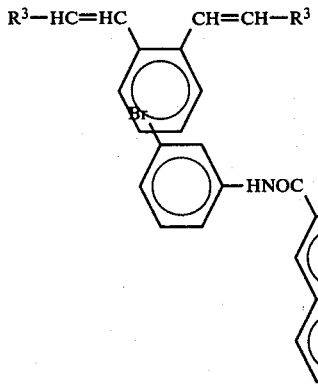

wherein $R^3$ represents a carbazoyl group, a pyridyl group, a thienyl group, an indolyl group, a furyl group, a phenyl group, a styryl group, a naphthyl group, an anthryl group, which phenyl group, styryl group, naphthyl group and anthryl group are unsubstituted or substituted with one member selected from the group consisting of a dialkylamino group, an alkyl group, an alkoxy group, a carboxyl group or an esterified carboxyl group, halogen, a cyano group, an aralkylamino group, an amino group, a hydroxy group, a nitro group and an acetylamino group.

2. A layered electrophotographic photoconductor as claimed in claim 1, wherein said charge generating material is

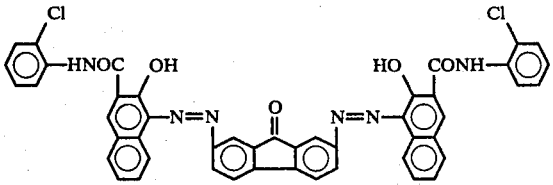

3. A layered electrophotographic photoconductor as claimed in claim 1, wherein said charge generating material is

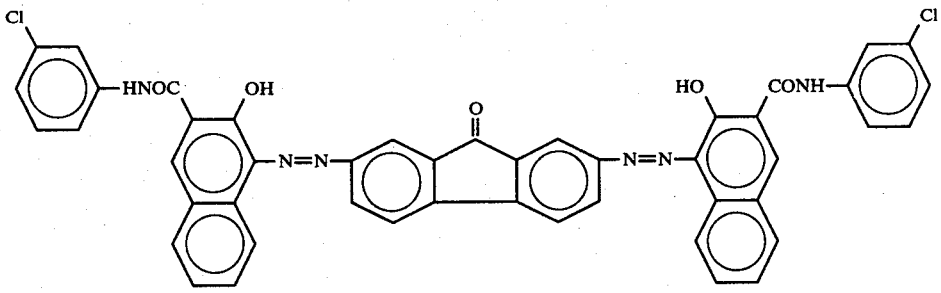

4. A layered electrophotographic photoconductor as claimed in claim 1, wherein said charge generating material is

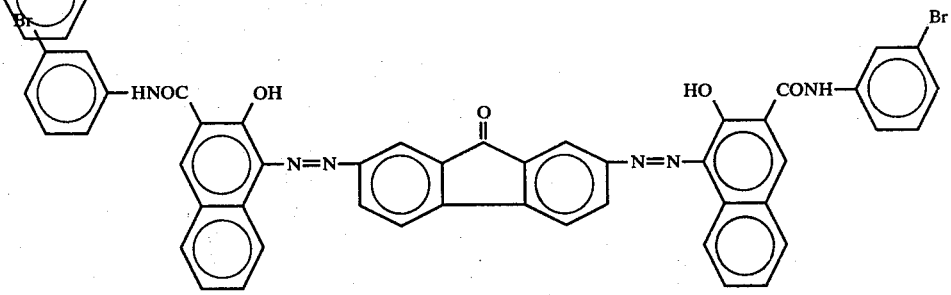

5. A layered electrophotographic photoconductor as claimed in claim 1, wherein said charge generating material is

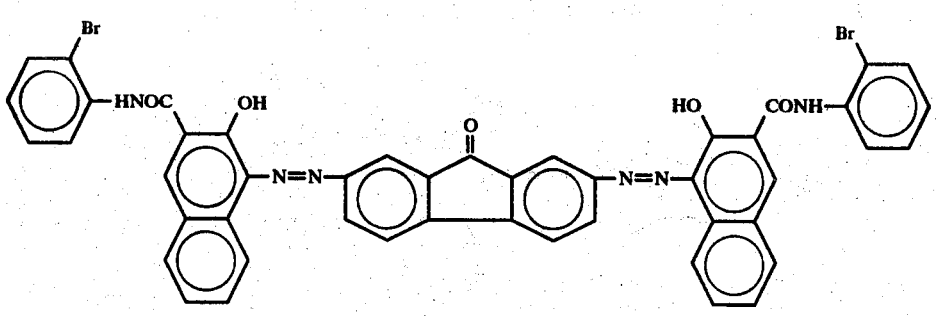

6. A layered electrophotographic photoconductor as claimed in claim 1, wherein said charge generating material is

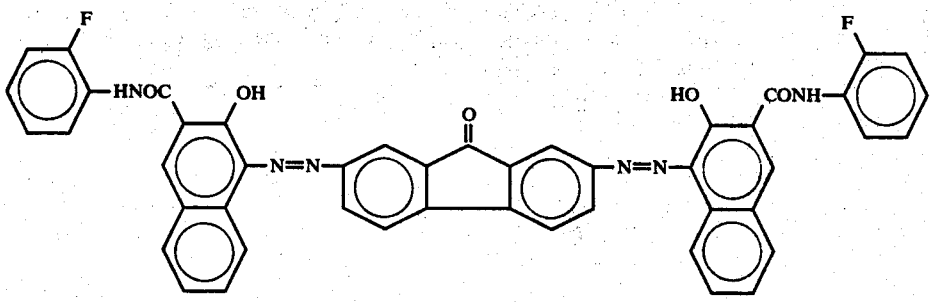

7. A layered electrophotographic photoconductor as claimed in claim 1, wherein said charge generating material is

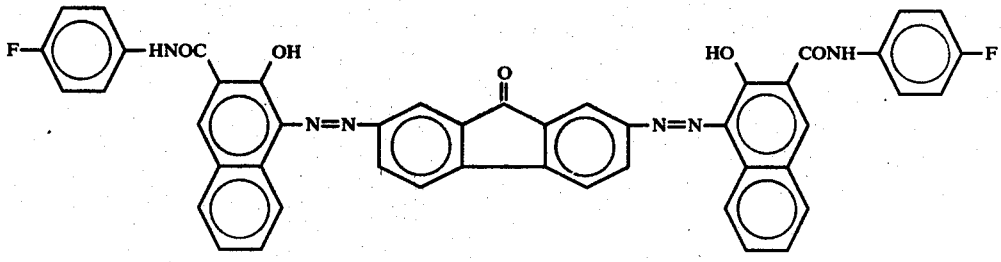

8. A layered electrophotographic photoconductor as claimed in claim 1, wherein said charge generating material is

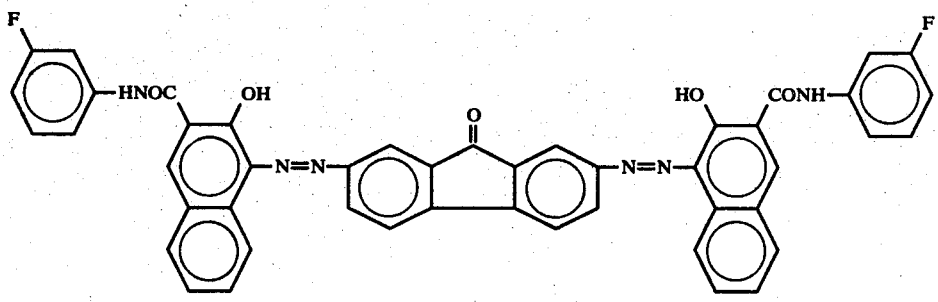

9. A layered electrophotographic photoconductor as claimed in claim 1, wherein said charge generating material is

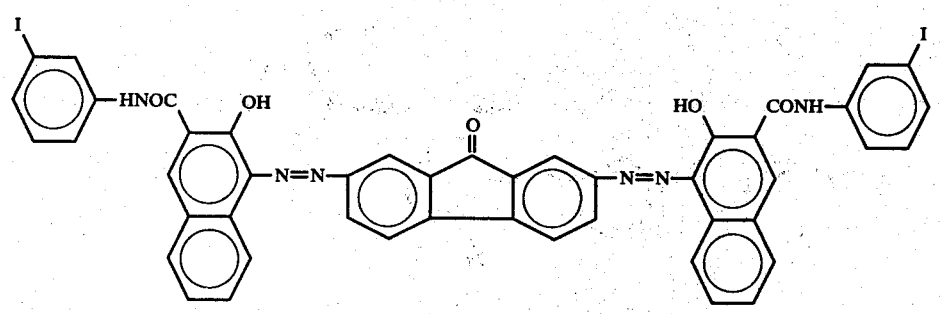

10. A layered electrophotographic photoconductor as claimed in claim 1, wherein the thickness of said charge generation layer is in the range of 0.01 μm to 5 μm and the content of said bisazo pigment in said charge generation layer is in the range of 10 to 100 weight percent and the thickness of said charge transport layer is in the range of 2 μm to 100 μm and the content of said anthracene compound in said charge transport layer is in the range of 25 to 75 weight percent.

11. A layered electrophotographic photoconductor as claimed in claim 1, wherein the thickness of said charge generation layer is in the range of 0.01 μm to 5 μm and the content of said bisazo pigment in said charge generation layer is in the range of 10 to 100 weight percent and the thickness of said charge transport layer is in the range of 2 μm to 100 μm and the content of said distyrylbenzene compound in said charge transport layer is in the range of 25 to 75 weight percent.

* * * * *

UNITED STATES PATENT AND TRADEMARK OFFICE

CERTIFICATE OF CORRECTION

PATENT NO. : 4 390 608

DATED : June 28, 1983

INVENTOR(S) : Mitsuru Hashimoto et al

It is certified that error appears in the above-identified patent and that said Letters Patent is hereby corrected as shown below:

Col. 31, in the space following line 45, the formula should read as follows:

--- 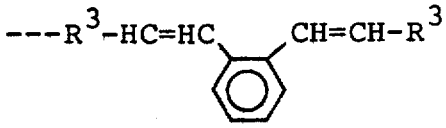 ---.

(3)

Col. 32, in the space between lines 46 and 65, the formula should read as follows:

--- 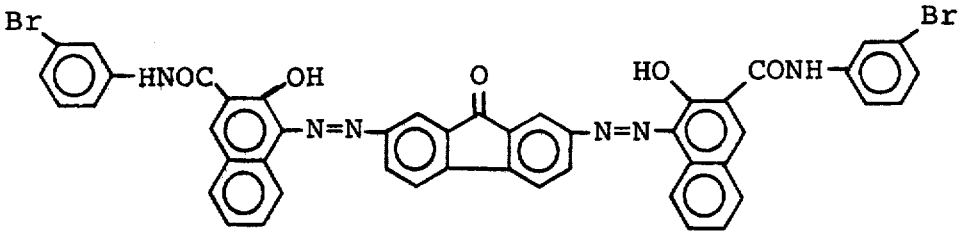 ---.

Signed and Sealed this

Nineteenth Day of June 1984

[SEAL]

Attest:

GERALD J. MOSSINGHOFF

Attesting Officer

Commissioner of Patents and Trademarks